US005752589A

United States Patent [19]

Berg

[11] Patent Number: 5,752,589

[45] Date of Patent: May 19, 1998

[54] REUSABLE POUCH

[76] Inventor: Norma Jean Berg, 8 Madison Avenue, Orangeville, Ontario, Canada, L9W 1S1

[21] Appl. No.: 598,172

[22] Filed: Feb. 7, 1996

[51] Int. Cl.[6] ..... A45C 3/02; A45C 13/10; A45C 13/42

[52] U.S. Cl. ..... 190/109; 190/901; 206/214; 281/31

[58] Field of Search ..... 190/100, 109, 190/901; 206/214, 307.1, 308.3; 150/143, 145; 281/31, 32

[56] References Cited

U.S. PATENT DOCUMENTS

| | | | |
|---|---|---|---|
| 352,358 | 11/1886 | Scherer | 206/214 X |
| 2,382,476 | 8/1945 | Glasoe, Jr. | 281/31 |
| 3,126,891 | 3/1964 | Caputi | 206/214 X |
| 3,154,125 | 10/1964 | Harvey | 190/901 X |
| 3,267,980 | 8/1966 | Bird | 150/145 |
| 3,301,295 | 1/1967 | Fitch | 190/100 |
| 4,108,307 | 8/1978 | Feingold et al. | 206/307.1 |
| 4,296,945 | 10/1981 | Pavlik | 281/1 |
| 4,318,471 | 3/1982 | Hutton | 206/214 |
| 4,388,958 | 6/1983 | Dworkin | 150/7 |
| 4,588,209 | 5/1986 | Zebrowski et al. | 281/45 |
| 4,738,390 | 4/1988 | Brennan | 229/77 |
| 4,890,728 | 1/1990 | Grimsley | 206/0.81 |
| 5,020,673 | 6/1991 | Adams | 150/145 X |
| 5,031,763 | 7/1991 | Lynam | 206/214 |
| 5,215,398 | 6/1993 | White et al. | 402/73 |
| 5,445,251 | 8/1995 | Redwood | 190/109 |

FOREIGN PATENT DOCUMENTS

| | | | |
|---|---|---|---|
| 581300 | 11/1959 | Canada | 150/143 |
| 335592 | 10/1989 | European Pat. Off. | 190/901 |
| 373318 | 6/1990 | European Pat. Off. | 190/901 |
| 4133465 | 4/1993 | Germany | 206/308.3 |

*Primary Examiner*—Sue A. Weaver
*Attorney, Agent, or Firm*—Ridout & Maybee

[57] ABSTRACT

A reusable information carrying folder has a stiffly resiliently flexible plastic cover formed with parallel hinge lines that define a middle panel, first and second side panels on each side of the middle panel and a tab member on a laterally outer edge of the second side panel. The middle, first and second side panels have equal widths and the tab member is relatively narrow. In use, the second side panel folds on the middle panel and the first side panel folds on the second side panel. The tab member is compressed between the first and second side panels. Releasable retainers on an outer face of the second side panel adjacent its hinge line adjacent the middle panel and on an inner race of the first side panel adjacent its lateral outer edge connect together and urge the first side panel toward the second side panel. This compresses the tab member with a mechanical advantage owing to the greater width of the first side panel as compared to the width of the tab member.

9 Claims, 6 Drawing Sheets

REUSABLE POUCH

BACKGROUND OF THE INVENTION

The present invention relates to a reusable pouch or communication purposes. The pouch of the invention may be used in communication between, for example schools and parents, for conveying notes, messages, money, newsletters, information sheets, report cards, or forms requiring parental signature in a relatively protected and secured manner. The pouch is not, however, limited to such communication and may, for example, be used in other applications, for example by doctors and medical personnel for transferring patient records, requisitions for medical tests and the like between offices, hospitals, clinical testing laboratories and the like.

Known reusable pouches or envelopes of which the applicant is aware have provided insufficient security and protection for the contents of the envelope, are not as convenient to use as is desirable, and have been prone to undesirably rapid wear.

SUMMARY OF THE INVENTION

In the present invention, a reusable pouch comprises an outer cover of stiffly resilient flexible plastic that is formed in one piece and has hinge lines on it that define a middle panel and a panel on each side of the middle panel. An inner pouch is formed of a sheet of relatively more flexible material that is bonded on the inner face of at least the middle panel. One side is left unattached to leave a mouth through which the inner pouch can be accessed. The two side panels; can be folded over onto the middle panel to form a protective enclosure over the inner pouch. One side panel may be provided with engagement means that coact with engagement means on the middle panel adjacent the mouth of the inner pouch so that when this side panel is folded downwardly, the inner sheet adjacent the mouth of the inner pouch is pinched shut. The other side panel may also have engagement means that coact with the outer side of the cover to retain the side panels in closed position.

In a further form, one side panel, that folded down first, has a laterally-extending tab that functions somewhat in the manner of a lever and is compressed when the other side panel is folded downwardly to the closed position. The pressure exerted by the lever-like tab exerts a pinching action that maintains the mouth of the inner pouch pinched shut.

BRIEF DESCRIPTION OF THE DRAWING

A preferred example of the reusable pouch in accordance with the invention will now be described in more detail by way of example only with reference to the accompanying drawings.

DESCRIPTION OF THE PREFERRED EMBODIMENTS

Figure 1:
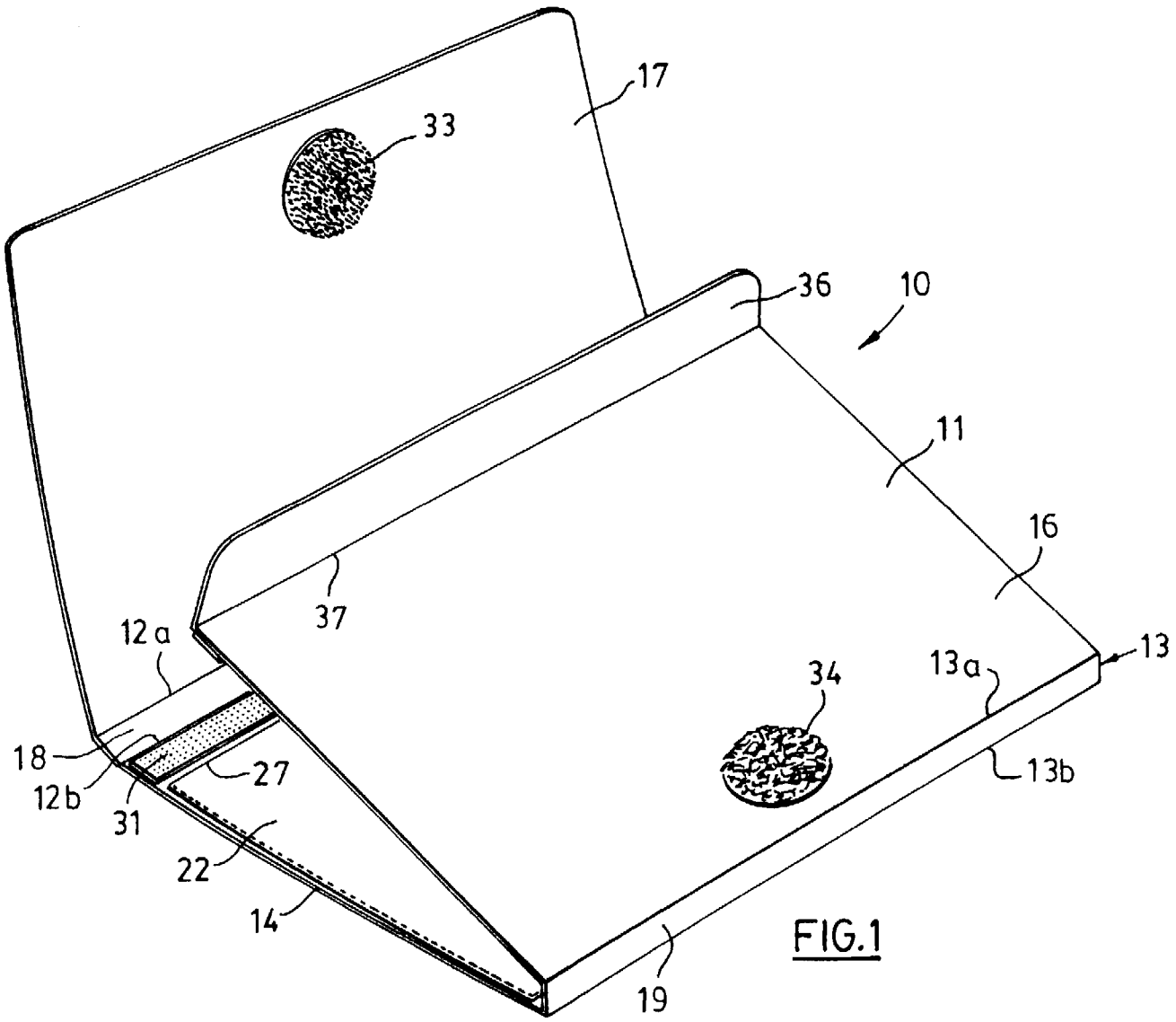
FIG. 1 is a perspective view of a reusable pouch in accordance with the invention in a half closed condition.

Referring to the accompanying drawings, the pouch 10 shown in FIGS. 1 to 7 has a stiffly resilient flexible plastic outer cover sheet 11 that is, a rectangular sheet of stiff plastic with rounded corners. In a preferred form the cover sheet 11 is cut from high density polyethylene. Preferably the material of the sheet comprises an opaque filler, so that the cover 11 is opaque. The sheet 11 is scored, for example with a hot knife or otherwise formed with transverse lines of weakness to provide transversely extending grooves or hinge lines 12 and 13. The hinge lines 12 and 13 divide the sheet 11 into a middle panel 14 and side panels 16 and 17 on each side of the middle panel 14, the panels 14, 16 and 17 being of approximately equal longitudinal extent.

Figure 7:
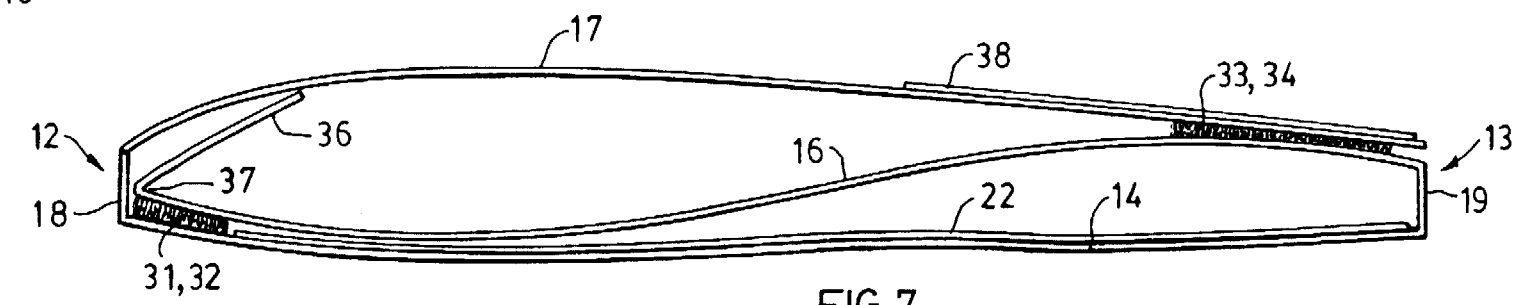
FIG. 7 is a side view showing the pouch in fully closed position.

In the preferred form, each hinge line 12 and 13 consists of a pair of score lines 12*a*, 12*b* and 13*a*, 13*b*, respectively, which define between them respective narrow spines 18 and 19 to provide some depth or inner capacity to the structure when folded up as seen in FIG. 7. The lines 12*a*, 12*b*, 13*a* and 13*b* may be on one or both faces of the sheet 11.

Figure 2:
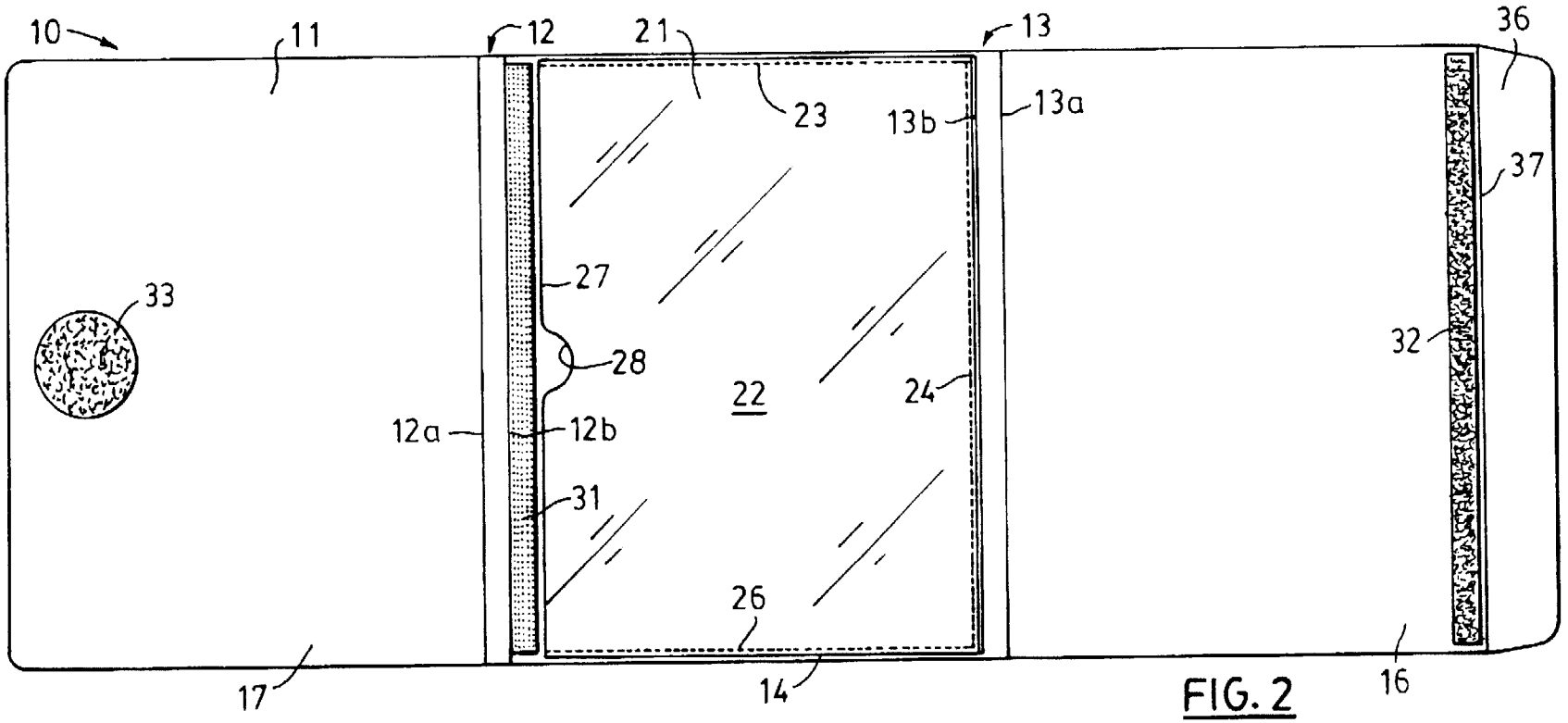
FIG. 2 is a plan view of an inner face of the pouch in fully open position.
Figure 3:
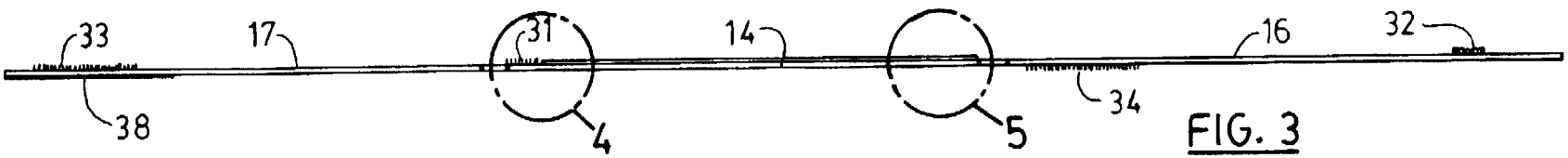
FIG. 3 is a side view of the pouch of FIG. 2.
Figure 4:
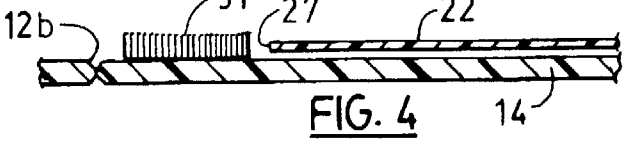
FIGS. 4 and 5 are cross-sections on an enlarged scale taken in the areas circled at 4 and 5 in FIG. 3, respectively.
Figure 5:
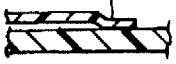
Figure 6:
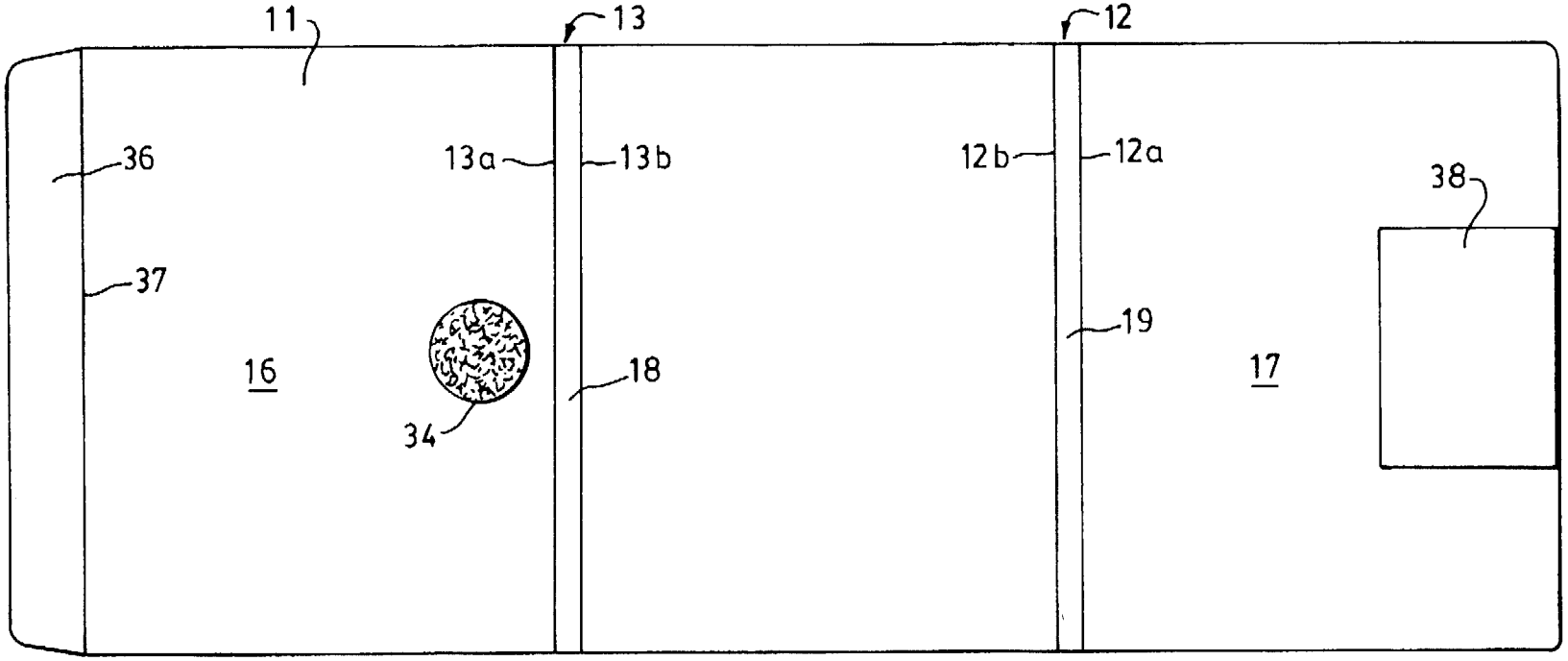
FIG. 6 is a plan view of the outer face of the cover of the reusable pouch of FIG. 1.

An inner pouch 21 is formed on the inner face of the sheet 11 by a sheet 22 of material that is flexible relative to the material of the sheet 11. For example, the sheet 22 may comprise a sheet of lower density polyethylene, and may be of thinner gauge than the sheet 11. The sheet 22 is applied on the inner face of the middle panel 14, and is bonded to the inner face of the sheet 11 at around its edges. For example, as seen in the accompanying drawings, the sheet 22 may be welded or fusion bonded in conventional fashion on three sides along weld lines 23, 24 and 26. A fourth side 27 of the sheet 22 is left attached and open to form a mouth through which the interior of the pouch 21 can be accessed. As seen in FIGS. 2 and 4, in the preferred form the open edge 27 is spaced inwardly from and is parallel to the hinge 13 connecting the middle panel 14 to side panel 17. The edge 27 may be indented with a finger recess 28 to facilitate insertion into and withdrawal of material from the pouch 21. Desirably the sheet 22 is transparent or clear plastic so that the contents of the pouch 21 cain be readily viewed.

The middle panel 14 and one side panel 16 are provided with coacting engagement means to locate the side panel 16 in a closed position, as seen in FIG. 7, wherein the panel 16 is folded downwardly over the middle panel 14 and to close the mouth of the inner pouch 21. In one form, the coacting means comprise hook and loop fastener strips (trademark VELCRO) 31 and 32 that are bonded on a marginal portion of the middle panel 14 between the hinge 12 and the edge 27 of the sheet 22 and on a laterally outer marginal portion of the inner face of the second side panel 16. The strips may be bonded to the cover 11 with a pressure sensitive adhesive. Alternatively, the strips 31 and 32 may comprise conventional pressure-sensitive adhesive backed mutually attractive magnetic tape material. Such magnetic tape material is readily available from various suppliers. One preferred form of magnetic tape comprises barium ferrite crystals dispersed in a polymer binder. Such material may provide a strong holding force, for example of at least 16 ounces weight per linear inch, and functions at temperatures from −40° F. to 160° F. Various other releasable fastener devices such as snap fasteners, dome fasteners and the like may be employed.

In use, materials to be transported in the pouch are placed into the pouch 21 through the mouth defined by the open edge 27, one side panel 16 is folded over and the strips 31 and 32 brought into contact: and pressed together, as seen in FIG. 7. The strong engagement between the strips 31 and 32 holds the portions of the panels 14 and 16 adjacent the strips 31 and 32 tightly together, so that these portions tend to pinch the mouth of the pouch 21 closed, and materials placed in the pouch, such as coins, papers, cards or the like are retained and will not tend to fall out. The other or outer panel 17 may then be folded over the panel 16, as seen in FIG. 7, and is desirably retained in a closed position by coacting engagement means on the side of the one side panel 1E and on the inner side of the other side panel 17. Such coacting engagement means may be similar to the strips 31 and 32, and may for example comprise pressure sensitive adhesive backed hook and loop fastener pads 33 and 34 bonded on an inner face of the cover 11 adjacent a marginal portion of the side panel 17 opposite the hinge 12 and on an outer face of the cover on an inner marginal portion of the side panel 16, adjacent the hinge 13, respectively. The folded down first panel 17 serves to provide an additional layer of protection for materials contained within the pouch 21, and encloses the edge of the panel 16 that is engaged on the middle panel 14, and reduces the risk of accidental disengagement of the coacting engagement means such as the VELCRO or magnetic strips 31 and 32.

In the preferred form, a tab member 36 extends laterally from a side of the side panel 16 opposite its hinge line 13 connecting to the middle panel 14. This tab member 36 may extend the full length of the side of the panel 16, or may be of shorter extent and be disposed generally adjacent a central portion of the side of the panel 16. In the preferred form, the tab member 36 is formed integrally with the sheet 11 and normally is die cut from the same sheet of plastic, and is joined to the panel 17 through a hinge line, for example a line of weakness or heat score line 37 on one or both faces of the sheet 11, to provide a hinge about which the tab member 36 tends to fold downwardly when the first panel member 17 is folded downwardly over the second panel member 16, as seen in FIG. 7. Tab member 36 performs a number of functions. Firstly, in the course of opening the pouch, after the side panel 17 has been unfolded upwardly from the panel 16, the tab 36 provides a convenient surface to be grasped by the fingers to lift the panel 16 upwardly.

Secondly, the tab member 36 performs a lever-like function increasing the compressive force tending to pinch the mouth of the pouch 21 shut. As will be seen from FIG. 7, when the panel 17 is folded downwardly and engaged through the interengaging coacting means 33 and 34, a portion of the inner face of the parcel 17 adjacent its point of attachment to the hinge 12 reacts compressively on the upper end of the tab member 36 and tends to compress or lever downwardly the marginal portions of the side panel 16 adjacent the coacting engaging means 31, 32, so that the material of the panel 16 is pressed downwardly to provide a pinching action with the sheet 22 adjacent the open edge 27, and hence the mouth of the pouch 21 is pinched firmly closed. In the preferred form, the closure of the mouth of the pouch 21 is so effective that the pouch 21 is water-tight and documents or other materials in the pouch 21 remain dry even when the pouch is immersed in water.

The outer face of the side panel 17, that forms the outer side of the pouch in the filly closed position, as seen in FIG. 7, may have bonded to it a label 38 of wax paper or the like that may be pre-printed with indicia providing information facilitating use of the pouch or information identifying the owner. For example, in the case of a pouch intended for communication between schools and parents or guardians, the label may be preprinted with legends such as "Student ID Number", "School", "Address", "If Lost Return To" so that the student user may write in this information in spaces provided along side the legends. The label may also carry important telephone numbers such as emergency numbers such as 911 services and the like. In the preferred form, the waxed or other surface of the label 38 is highly receptive of ball-point ink, so that ballpoint ink writing on the label tends to be indelible and unaffected by wet weather conditions.

Various modifications of the pouch of the invention are contemplated.

Figure 8:
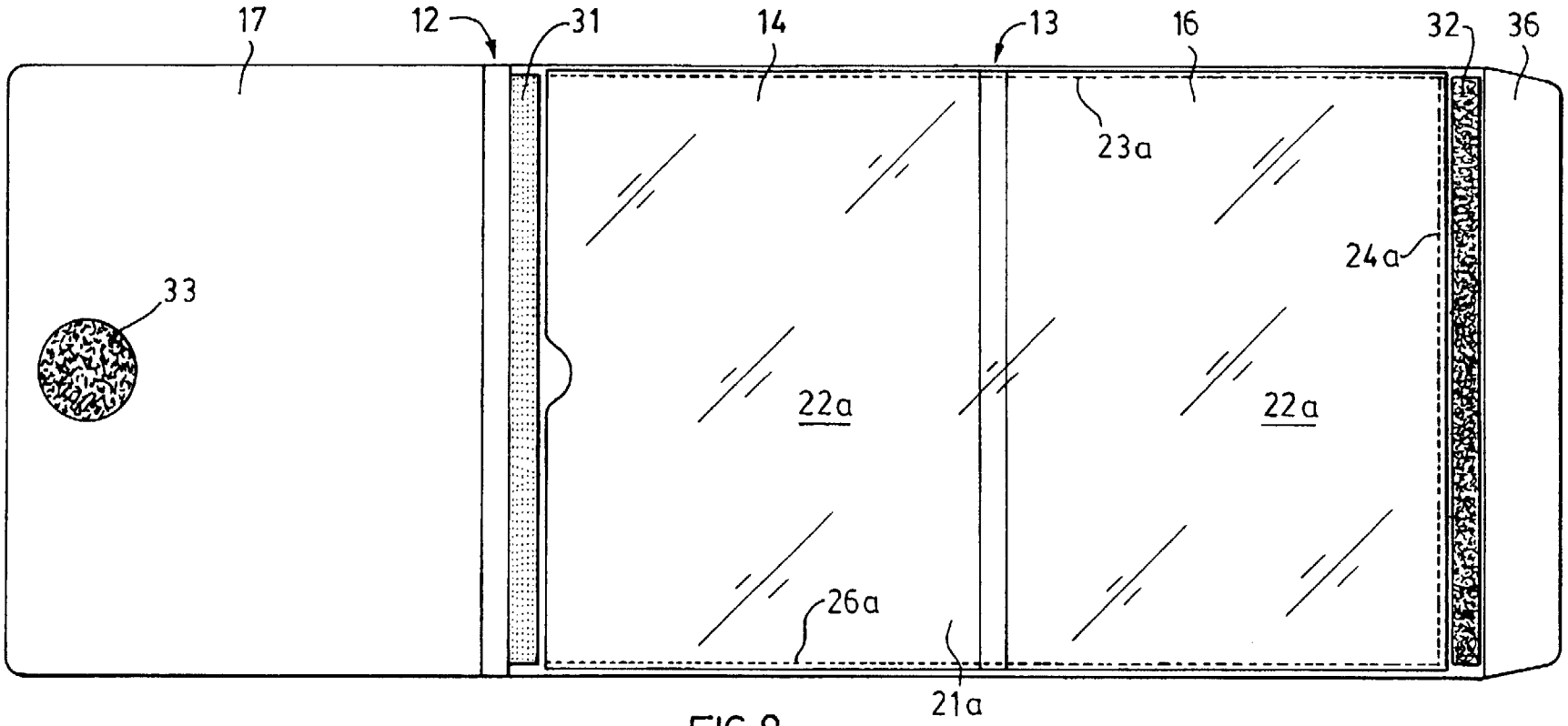
FIG. 8 is a plan view of the inner face of a modified form of the pouch.

For example, as shown in FIG. 8, which is a plan view of the inner face of the pouch similar to FIG. 2, the pouch may be modified in that its inner pouch **21*a* may extend over two adjacent panels 14 and 16, the inner sheet 22*a* being of somewhat longer dimension than the sheet 22 seen in FIG. 2 and being welded or otherwise bonded to the inner face of the sheet 11 along lines 23*a*, 24*a* and 26*a***.

Figure 9:
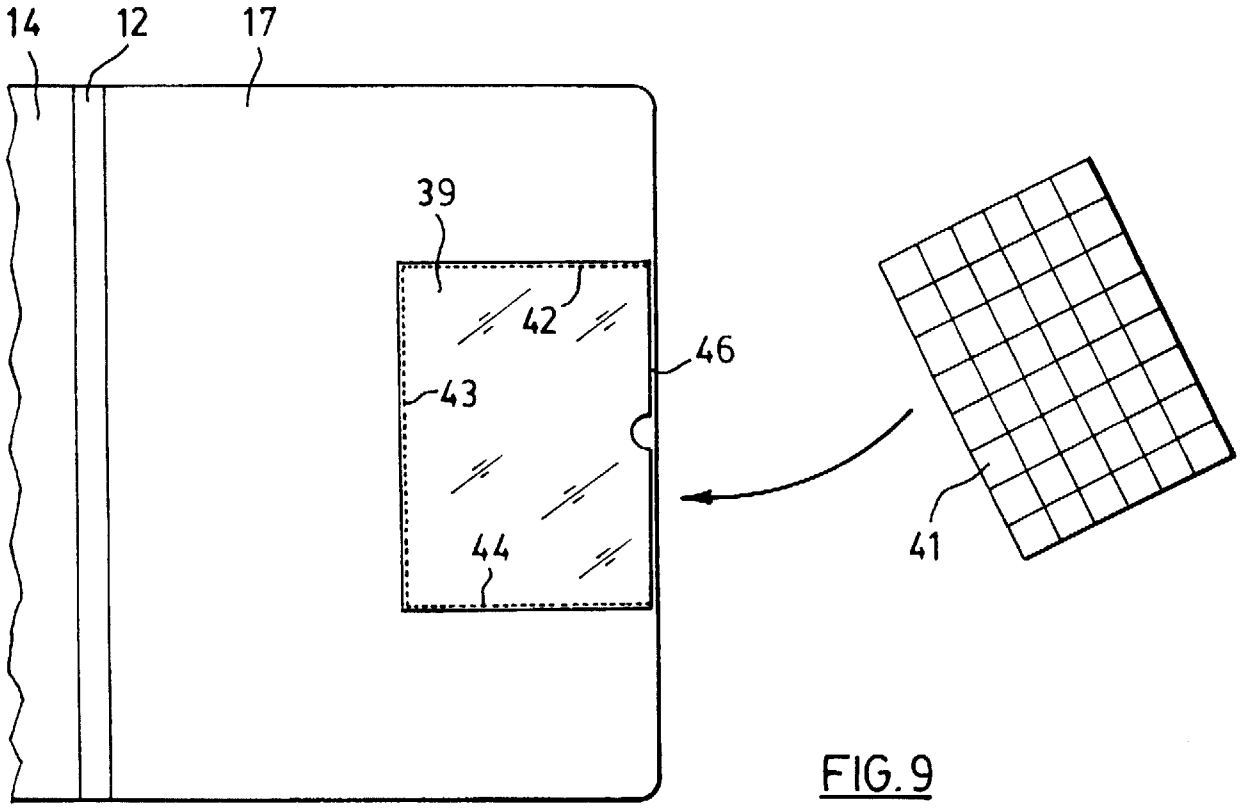
FIG. 9 is a partial plan view of the outer face of a further modified version of the pouch.

In a further modification, as seen in FIG. 9, instead of a label 38, the outer face of side panel 17 may be provided with a pocket 39 for receiving a card 41. Desirably, the pocket 39 is formed of a sheet of transparent or clear plastic welded or otherwise bonded to the sheet 11 along edges 42, 43 and 44, leaving an opposite edge 46 open to enable the card 41 to be inserted in or removed from the pocket 39. The card 41 may be provided with indicia providing information as to one or more recipients of the pouch. For example, the card 41 may be printed with a rectangular grid, as seen in FIG. 9, on which a list of recipients to whom the pouch is to be circulated may be written. Alternatively, or in addition, the card may indicia requiring a recipient to acknowledge receipt. For example, the card may bear a legend such as "To acknowledge receipt of the enclosed material please initial box number 3" or the like, whereby the distributor of the material can receive an acknowledgement on return of the material that it has been received by the intended recipient. Preferably, as shown, the pocket sheet material 39 is clear plastic, so that information written or printed on the upper most face of the card 41 can be viewed and read through the sheet 39 without removing the card 41 from the pocket.

Figure 10:
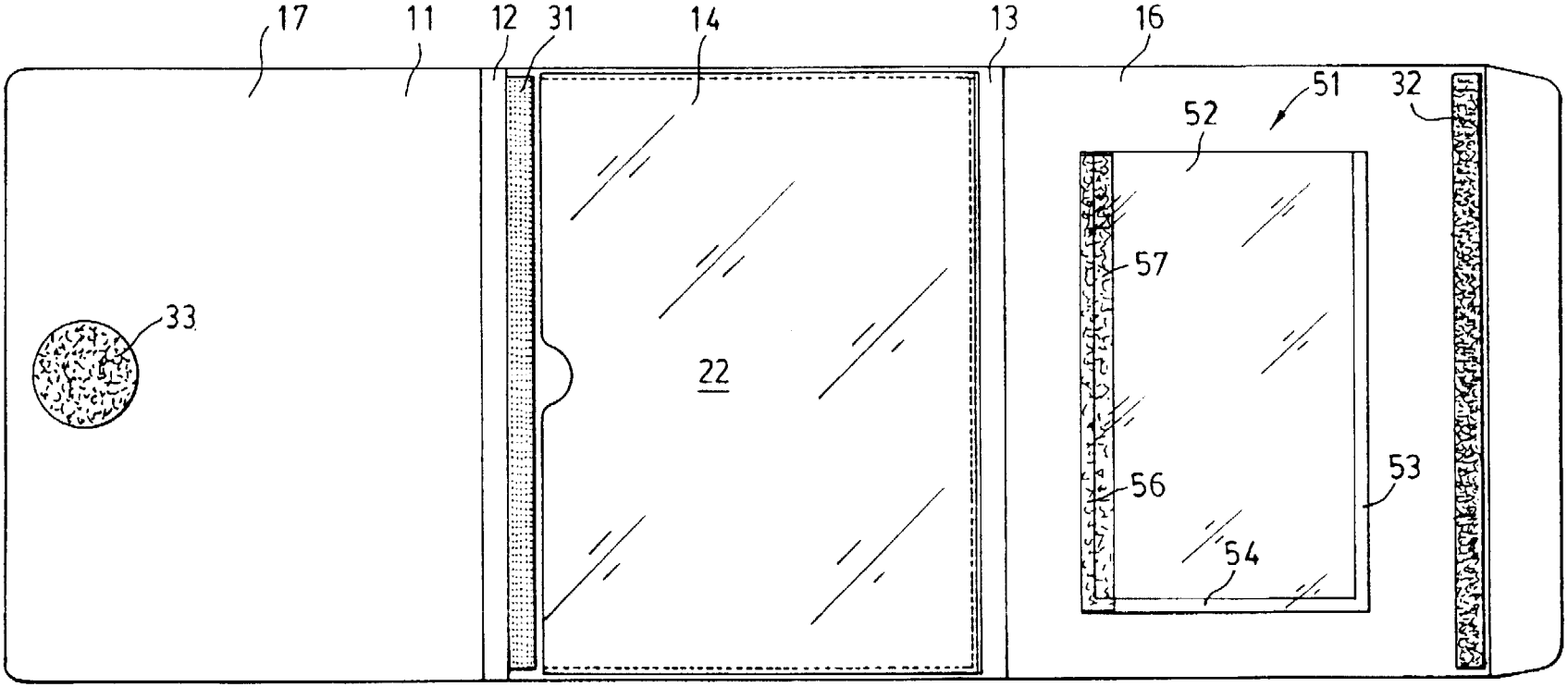
FIG. 10 is a plan view of the inner face of a still further modified version of the pouch.

In a further modification a removable bag-like pouch is removably attached to an inner face of a panel of the cover 11. For example FIG. 10 shows a rectangular bag 51, comprising for example two thicknesses of clear plastic 52 face to face and sealed or united together along three edges, for example edges 53, 54 and 56. The bag 51 may be removably connected to an inner face of panel 16. For example an edge of the bag 51 may be bonded to a strip 57 of hook and loop fastener material coacting with another strip bonded to the inner face of the panel 16.

The present pouch structure can readily be formed of sturdy plastic sheet materials, that will resist wear and hence make the pouch usable for a prolonged period for a multiplicity of transfers between issuers and recipients.

Moreover, the reusable pouch structure is adapted to be formed largely of recycled materials. The plastic sheets materials comprising the cover sheet 11, internal pouch sheet 22 or **22*a*, external pocket sheet 39 and bag 52** may all be formed of plastics consisting of or substantially comprising quantities of recycled plastics, including post consumer waste plastics. It is contemplated that, when magnetic strip materials are employed, magnetic materials recycled from refrigerator and freezer magnetic door seals may be used.

I claim:

1. A reusable information carrying folder comprising: a one piece outer cover of stiffly resiliently flexible plastic formed with parallel hinge lines that define a middle panel, first and second side panels on each side of said middle panel and a tab member on a laterally outer edge of said second side panel; said middle, first and second side panels each being of substantially equal lateral width and said tab member being of substantially shorter lateral width; said second side panel folding on said middle panel and said first side panel folding on said second side panel and said tab member being compressed between said first and second side panels in a closed position of the folder; and a releasable fastener on an outer face of said second side panel adjacent its hinge line adjacent the middle panel releasably fastening said outer face of said second side panel to an inner face of said first side panel adjacent its lateral outer edge and urging said first side panel toward said second side panel and compressing said tab member with a mechanical advantage owing to the greater lateral width of the first side panel as compared to the lateral width of the tab member.

2. A folder as claimed in claim 1, wherein said hinge lines each comprise two spaced parallel hinge lines defining between them a spine that is narrow compared to the width of the panels and tab member.

3. A folder as claimed in claim 1 wherein the releasable fastener comprise hook and loop fastener strips.

4. A folder as claimed in claim 1 having a pocket on an outer face of said first side panel receiving a card bearing indicia for identifying one or more recipients of the reusable folder.

5. A folder as claim in claim 4 wherein the pocket is formed of transparent plastic.

6. A folder as claimed in claim 1 including an inner sheet of flexible material that extends over an inner face of said cover and is bonded to said cover with one side that is adjacent the tab member in the closed position left open and forming a mouth that can be accessed when the folder is in an open position and that is compressed in the closed position of the folder.

7. A folder as claimed in claim 6 wherein said sheet extends over the middle and a side panel.

8. A folder as claimed in claim 6 wherein the sheet is fusion bonded to the cover.

9. A folder as claimed in claim 6 wherein the inner sheet is transparent plastic.

* * * * *